US006626752B2

(12) United States Patent
Zimmermann et al.

(10) Patent No.: US 6,626,752 B2
(45) Date of Patent: Sep. 30, 2003

(54) DEVICE FOR SORTING COINS WITH A COIN COLLECTION CONTAINER CONFIGURED AS A SLEEVE CONTAINER

(75) Inventors: Thomas Zimmermann, Berlin (DE); Gerhard Röhrs, Dannenberg (DE)

(73) Assignee: F. Zimmermann GmbH & Co. KG (DE)

( * ) Notice: Subject to any disclaimer, the term of this patent is extended or adjusted under 35 U.S.C. 154(b) by 57 days.

(21) Appl. No.: 09/875,123

(22) Filed: Jun. 6, 2001

(65) Prior Publication Data

US 2002/0144878 A1 Oct. 10, 2002

(30) Foreign Application Priority Data

Jun. 7, 2000 (DE) ..... 200 10 040 U

(51) Int. Cl.[7] ..... G07D 3/04

(52) U.S. Cl. ..... 453/59; 453/9; 453/11; 453/31; 53/254

(58) Field of Search ..... 453/9, 11, 31, 453/59, 61, 62; 53/254

(56) References Cited

U.S. PATENT DOCUMENTS

| | | | | | |
|---|---|---|---|---|---|
| 1,673,709 | A | * | 6/1928 | Reid et al. | 453/12 |
| 1,819,235 | A | * | 8/1931 | Donnellan | 235/132 R |
| 1,908,565 | A | * | 5/1933 | Smith | 235/100 |
| 1,919,963 | A | * | 7/1933 | Smith | 53/254 |
| 2,289,002 | A | * | 7/1942 | Fleming et al. | 235/132 R |
| 2,620,109 | A | * | 12/1952 | Smathers | 53/254 |
| 2,749,001 | A | * | 6/1956 | Reis | 141/183 |
| 4,495,959 | A | * | 1/1985 | Farber | 453/61 |
| 4,593,709 | A | * | 6/1986 | Duplessy | 453/31 |
| 5,902,178 | A | * | 5/1999 | Perkitny | 453/61 |
| 6,099,401 | A | * | 8/2000 | Perkitny | 453/61 |

* cited by examiner

*Primary Examiner*—Kathy Matecki
*Assistant Examiner*—Sang Kim
(74) *Attorney, Agent, or Firm*—McGlew and Tuttle, P.C.

(57) ABSTRACT

A machine for the sorting of coins and the placement of the coins into coin wrapper sleeves, containers or bags according to their type. A coin feed device in the form of a rotating table (1) feeds coins to a sorting plate (2) having a plurality of sorting openings (3), wherein each sorting opening corresponds to a particular denomination or size of a coin or disk. Each sorting opening (3) feeds into a corresponding coin outlet channel (4,4') which conducts coins passing through the sorting opening (3) to a corresponding sleeve container (5). Each corresponding sleeve container (5) is connected to the corresponding outlet channel part (4') by means of a bayonet-type connector. Each sleeve container (5) has a carrying bracket (8) to support a coin wrapper sleeve (6) while it is being filled with coins. A removal opening (7) is used to remove the coin wrapper sleeve (6) from the sleeve container (5) when it is full by swinging the carrying bracket (8) to the side releasing the coin wrapper sleeve (6). A sleeve receiving opening (9) above each sleeve container (5) is provided for insertion of coin wrapper sleeves into the sleeve containers (5). A lid (10) covers the sleeve receiving openings (9).

20 Claims, 3 Drawing Sheets

DEVICE FOR SORTING COINS WITH A COIN COLLECTION CONTAINER CONFIGURED AS A SLEEVE CONTAINER

FIELD OF THE INVENTION

The novelty relates to a device for sorting coins of one or more pluralities of coins, comprising a coin feed device, a sorting plate adjacent to said coin feed device, said sorting plate comprising sorting openings corresponding to different coins of a plurality of coins, to each sorting opening a coin outlet channel being connected and at the outlet side a sleeve container being connectable to the coin outlet channel, each individual sleeve being insertable into the sleeve container with the provision that coins coming out of the coin outlet channel will fall into the sleeve.

The adjustment of the sorting openings to different coin diameters of a plurality of coins may for instance be achieved by the sorting openings, configured as a stepped sequence, having a diameter increasing in the feed direction. The dimensioning of each sorting opening is adjusted to the diameter of a certain coin value. The sorting plate may be permanently installed, or may be exchangeable. An exchangeable sorting plate permits short-term changes between different pluralities of coins. By such a device it is finally achieved that in the coin collection containers assigned to the respective sorting openings only coins of a certain value of a plurality of coins are collected.

BACKGROUND OF THE INVENTION

From practical experiences, it is known to adapt the coin collection container as a coin bag or a rigid coin container. Further, sleeve containers are also known in the art.

In the prior art devices equipped with sleeve containers, the sleeves are introduced from below into the sleeve container, with locking systems having to be activated. A sleeve is a cylindrically wrapped paper container with a collar at one side, this collar preventing coins from falling out. Towards the opposite open end, such a sleeve typically is shaped in a slightly conically opening manner, in order to permit the coins to fall in a controlled manner into the sleeve. After a defined quantity of coins having been introduced into the coin sleeve, another collar is formed at the second end of the coin sleeve, such that the filled-up coin sleeve is ready for transportation and handling.

It is disadvantageous, in the prior art device for sorting coins, that the introduction of a sleeve into the sleeve container is time-consuming, and that the open end of the sleeve may be bent away, with the consequence that coins will not properly fall into the sleeve anymore.

SUMMARY AND OBJECTS OF THE INVENTION

The novelty is based on the technical problem to provide a device for sorting coins, wherein the introduction of a sleeve can be achieved in a simple and safe manner.

For achieving this object, the novelty teaches that the coin outlet channel comprises a sleeve receiving opening above the connected sleeve container.

It is achieved, by the novelty, that sleeves can be inserted in a simple manner. Further, the risk of a deformation of the open end of the sleeve is avoided, since the sleeve will fall down with the collar towards the front. As a result, particularly safe operation and function are secured.

Preferably, the sleeve container is at least on its inner face cylindrically shaped, the inner diameter of the sleeve container being larger by 0.5 to 10 mm, preferably 0.5 to 3 mm, than the largest sleeve diameter. It is understood that the inner diameter is adjusted to the sleeve diameters corresponding to the coins of different values. In so far, a different sleeve container is required for each coin value, within the specified tolerances. For only slightly differing coin diameters, the same sleeve containers may be used. Suitably, the sleeve is oriented vertically. This permits that sorted coins failing into the sleeve are immediately stacked.

In a preferred embodiment of the novelty, it is provided that the sleeve container has, at its end directed away from the coin outlet channel, a removal opening of a size permitting removal of a sleeve, and that in the area of the end directed away from the coin outlet channel, a carrying bracket is provided in a swingable manner, such that the carrying bracket is movable between an operating position, to where a sleeve is carried by the carrying bracket, and a removal position, where the carrying bracket releases the removal opening. In principle, the carrying bracket can be held in the operating position in various ways. In particular, a latch may be provided for this purpose. It is however preferred that the carrying bracket is held in the operating position by its own weight. For the removal position of the carrying bracket, a latch may be provided, but is however not absolutely necessary.

The sleeve container is preferably adapted as an exchangeable unit. This will permit, at the occasion of replacement of the sorting plate for another plurality of coins, connection of correspondingly adjusted sleeve containers to the outlet channel. Further, the optional application of bags or containers as coin collection containers is possible, if necessary with intermediate coin tubes. The connection may be performed in various ways. For instance, latch elements, clamping levers, knurled screws or other screws are possible. It is however preferred to connect the sleeve container by means of a bayonet-type fitting.

For a particularly simple and easy filling of the sleeve container by a sleeve with simultaneous compact design, it is preferred that the sleeve receiving opening is angled with respect to a central axis of the sleeve container. The sleeve receiving opening may be adapted for being closed by a lid connected with a horizontal swing axis when the sleeve container is fitted.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
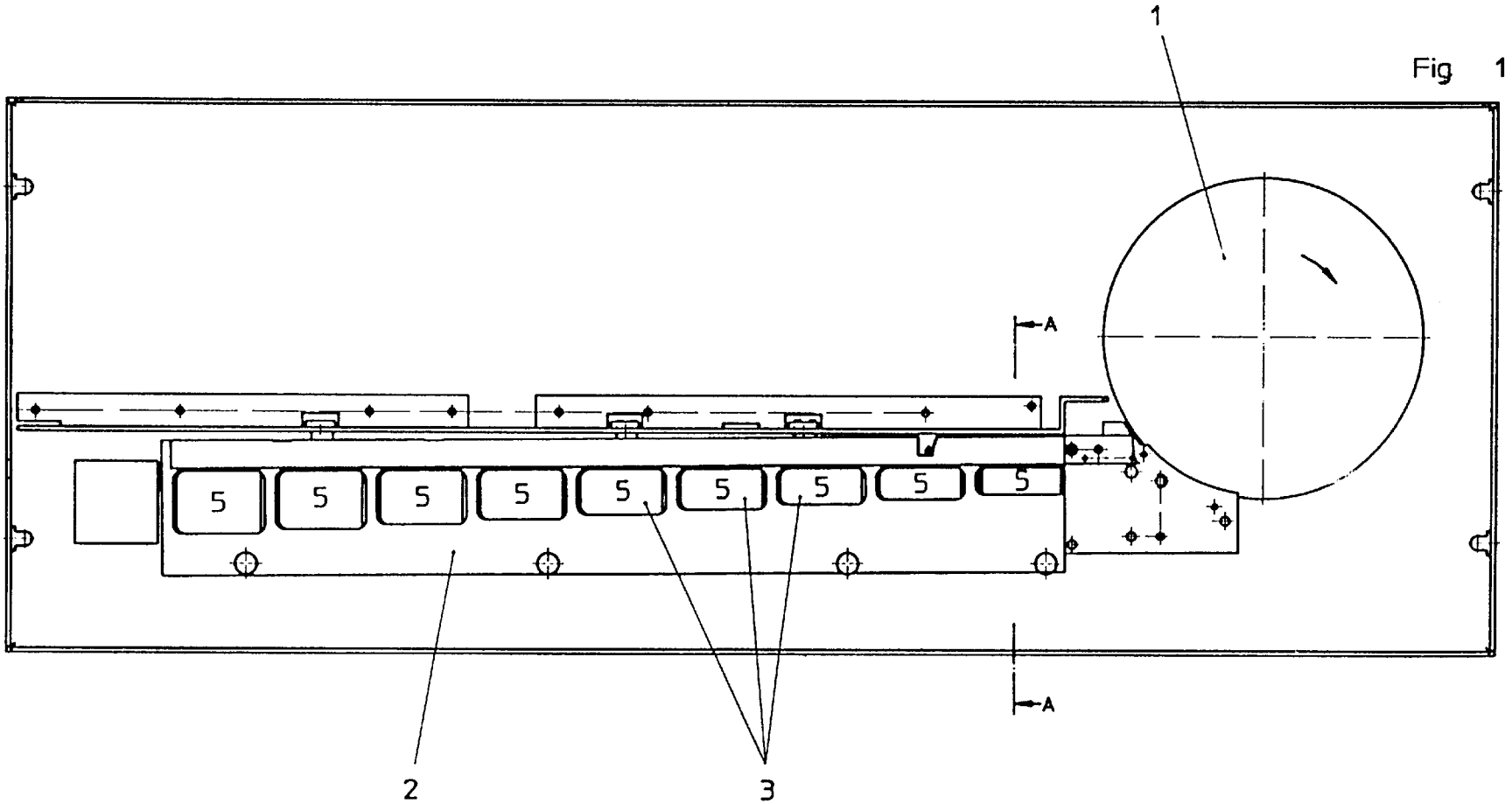
FIG. 1 is a plan view of a device for sorting coins according to the invention.
Figure 2:
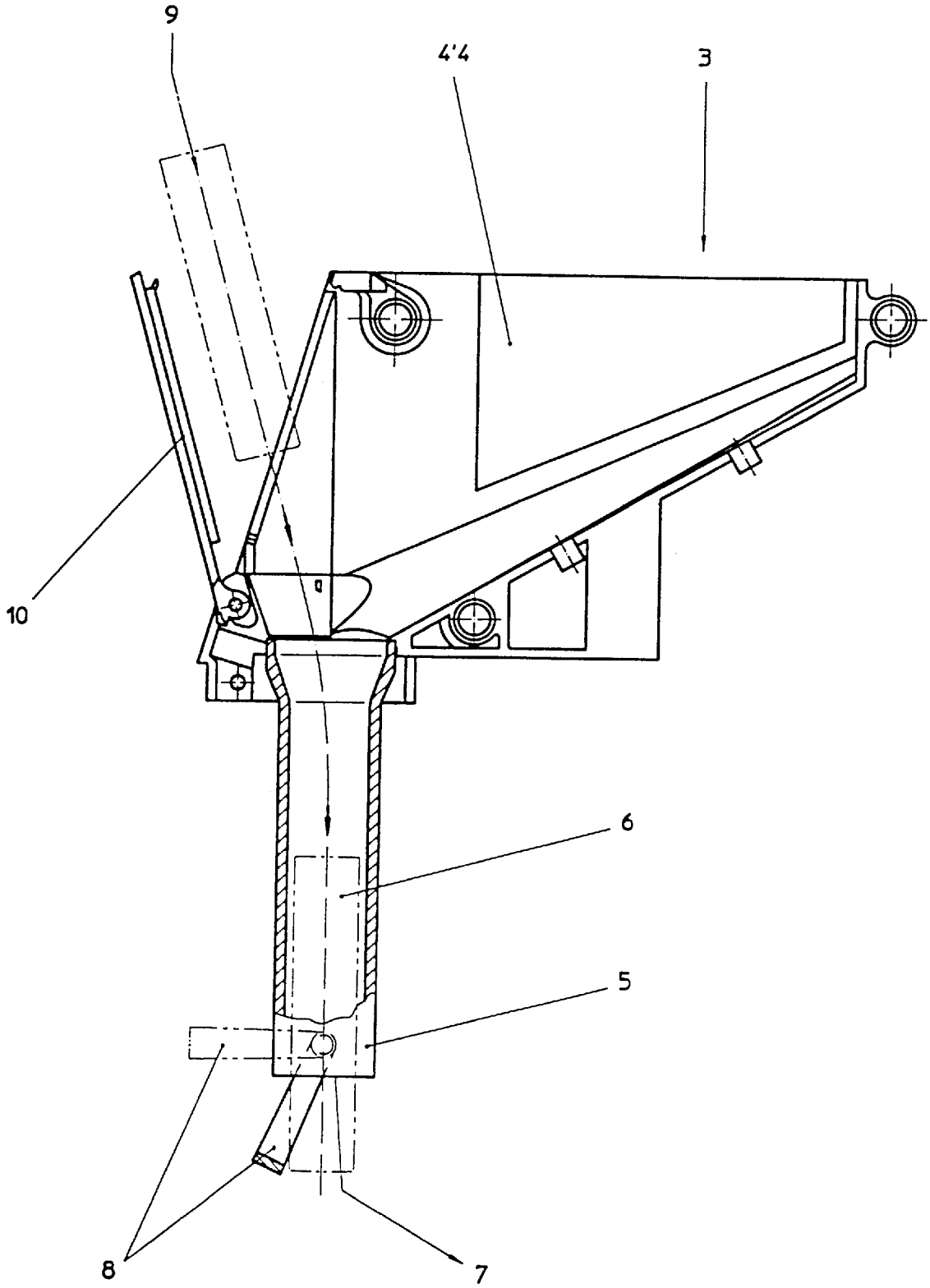
FIG. 2 is a diagrammatical cross-section in the plane A—A of FIG. 1.

Referring to the drawings in particular, FIG. 1 shows a device for sorting disks such as coins, comprising a coin feed device 1, a sorting plate 2 adjacent to said coin feed device 1, said sorting plate comprising sorting openings 3 corresponding to different coins of a plurality of coins. The coin feed device 1 is a rotating table. The sorting plate 2 is exchangeable for different pluralities of coins. When comparing FIGS. 1 and 2, it can be seen that to each sorting opening 3 a coin outlet channel 4, 4' is connected. The coin outlet channel 4, 4' is a two-piece unit with a coin outlet channel part 4 firmly connected on the side of the device and a releasable coin outlet channel part 4'. At the outlet side a sleeve container 5 is connectable to the coin outlet channel 4, 4'. The connection of the sleeve container 5 to the coin outlet channel part 4'is achieved by means of a bayonet-type fitting. In FIG. 2 it can be seen that a coin falling through a sorting opening 3 will fall through the coin outlet channel 4, 4' into a sleeve 6 inserted into the sleeve container 5. For an optimum stacking of the coins in the sleeve 6, the sleeve container 5 is oriented vertically; it may however also be oriented at an acute angle, for instance 1° to 40°, with respect to the vertical plane. In the shown embodiment, the sleeve container 5 is cylindrically shaped on its inner and outer face, the inner diameter of the sleeve container being larger by 2 mm than the largest sleeve diameter. The largest sleeve diameter is in the representation of FIG. 2 at the upper end of the sleeve 6.

Figure 3:
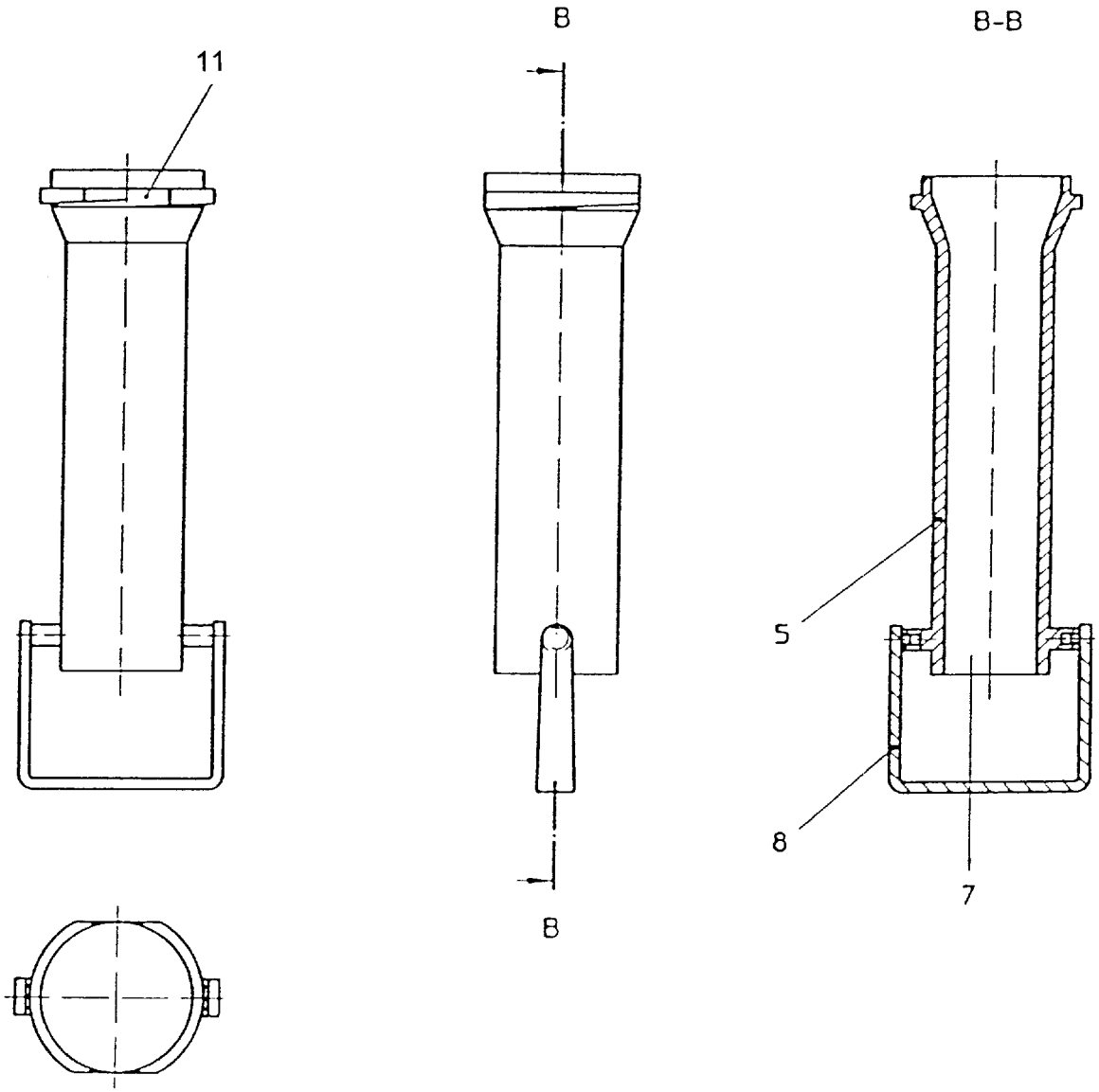
FIG. 3 shows diagrammatical and cross-sectional views of a sleeve container.

Comparing FIGS. 2 and 3 reveals that the sleeve container 5 has, at its end directed away from the coin outlet channel 4, 4', a removal opening 7 of a size permitting removal of a sleeve 6. In the area of the end directed away from the coin outlet channel 4, 4' a carrying or support bracket 8 is provided in a swingable manner, such that the carrying bracket 8 is movable between an operating position, where to a sleeve 6 is carried by the carrying bracket 8, and a removal position, where the carrying bracket 8 releases the removal opening 7. In the representation of FIG. 2, the carrying bracket is shown in dotted lines in the removal position.

The carrying bracket 8 is held in the operation position by its own weight, or will fall into the operating position under the action of its own weight. It is understood that the swing bearing of the carrying bracket 8 has sufficient clearance or smoothness.

In FIG. 2, it can further be seen that the coin outlet channel part 4' comprises above the sleeve container 5 a sleeve receiving opening 9. A sleeve 6 can easily be inserted or thrown through the sleeve receiving opening into the sleeve container 5. The sleeve receiving opening 9 is adapted for being closed by a lid 10 preferably connected with a horizontal swing axis at the sleeve container 5. The lid opens above the swing axis.

While specific embodiments of the invention have been shown and described in detail to illustrate the application of the principles of the invention, it will be understood that the invention may be embodied otherwise without departing from such principles.

What is claimed is:

1. A device for sorting a plurality of coins and depositing the coins into a plurality of sleeves, the device comprising:

a coin feed device;

a sorting plate receivable of the coins from said coin feed device, said sorting plate being arranged adjacent to said coin feed device, said sorting plate defining a plurality of sorting openings corresponding to different coins of the plurality of coins;

a coin outlet channel connected to each sorting opening, said coin outlet channel defining a sleeve receiving opening and a coin receiving opening spaced separately from said sleeve receiving opening;

a sleeve container connected to each said coin outlet channel, each of the individual sleeves being insertable into said each sleeve container and arranged in said sleeve container to receive coins from a respective said coin outlet channel, said sleeve receiving opening being arranged upstream of the connected sleeve container.

2. A device according to claim 1, wherein the plurality of sleeves have different sleeve diameters, said sleeve container has an inner face and an inner diameter, said inner face is cylindrically shaped with said inner diameter of said sleeve container being larger by 0.5 to 10 nm than a largest sleeve diameter of the plurality of sleeves.

3. A device according to claim 2 wherein said sleeve receiving opening is angled with respect to a central axis of said sleeve container.

4. A device according to claim 2 further comprising a lid selectively closing said sleeve receiving opening.

5. A device according to claims 1, wherein the plurality of sleeves have different sleeve diameters, said sleeve container has an inner face and an inner diameter, said inner face is cylindrically shaped with said inner diameter of said sleeve container being larger by 0.5 to 3 mm than a largest sleeve diameter of the plurality of sleeves.

6. A device according to claim 1 wherein said sleeve container is oriented vertically.

7. A device according to claim 1 wherein said sleeve container has an end directed away from said coin outlet channel, said end of said sleeve container defining a removal opening of a size for removal of the sleeves, and that in the area of said end;

a carrying bracket is swingably attached at said end of said sleeve container, said carrying bracket being movable between an operating position and a removal position, said carrying bracket carries the sleeve in said sleeve container when said carrying bracket is in said operating position, and said carrying bracket in said removal position releases said sleeve in said sleeve container.

8. A device according to claim 7, wherein said carrying bracket is held in said operating position by gravity.

9. A device according to claim 7, wherein said sleeve container is connected to said coin outlet channel by a bayonet-type fitting.

10. A device according to claim 7 wherein said sleeve receiving opening is angled with respect to a central axis of said sleeve container.

11. A device according to claim 1 wherein said sleeve container is connected to said coin outlet channel by a bayonet-type fitting.

12. A device according to claim 1 wherein said sleeve receiving opening is angled with respect to a central axis of said sleeve container.

13. A device according to claim 1 further comprising a lid selectively closing said sleeve receiving opening.

14. A device according to claim 1 further comprising a lid selectively closing said sleeve receiving opening, said lid being mounted pivotably about a horizontal axis with a first position where said lid closes said sleeve receiving opening, and a second position where said lid is spaced from said sleeve receiving opening.

15. A device according to claim 1, wherein:

said coin outlet channel is arranged between said sorting plate and said sleeve container;

said coin outlet channel defines a coin outlet opening feedable of the coins and sleeves from said coin outlet channel to said sleeve container;

said coin outlet channel defines a first path from one of said sorting openings to said sleeve container;

said coin outlet channel defines a second path from said sleeve receiving opening to said sleeve container.

16. A device for sorting disks into a sleeve comprising:

a sleeve container receivable of the disks and receivable of a sleeve; and a disk channel mounted to said sleeve container and defining a first path feedable of disks into the sleeve in said sleeve container, said first path having a disk opening receivable of the disks, said disk channel defining a second path feedable of the sleeve into said sleeve container, said second path having a sleeve receiving opening receivable of the sleeve, said disk opening and said sleeve receiving opening being separate and spaced from each other.

17. A device according to claim 16, further comprising:

a lid selectively covering said sleeve receiving opening.

18. A device according to claim 16 further comprising:

a lid with a horizontal swinging axis selectively covering said sleeve receiving opening.

19. A device for sorting disks into a sleeve, the device comprising:

a sleeve container receivable of the disks and receivable of the sleeve; and a disk channel mounted to said sleeve container and having a channel outlet feedable of the disks aid the sleeve into said sleeve container, said disk channel defining a first path having a disk opening receivable of the disks and leading to said channel outlet, said disk channel defining a second path having a sleeve receiving opening receivable of the sleeve and leading to said channel outlet, said disk opening and said sleeve receiving opening being separate and spaced from each other.

20. A device accordance with claim 19, further comprising:

a sorting plate defining a plurality of sorting openings corresponding to different sizes of the disks, one of said sorting openings being adjacent said disk opening of said disk channel;

a feed device feeding the disks to said sorting plate.

* * * * *